US006597092B1

(12) United States Patent
Furusawa et al.

(10) Patent No.: US 6,597,092 B1
(45) Date of Patent: Jul. 22, 2003

(54) SHADOW MASK HAVING PARTICULAR DESIGN OF UPPER AND LOWER HOLES FOR IMPROVED STRENGTH AND HALATION CHARACTERISTICS

(75) Inventors: Takeharu Furusawa, Mobara (JP); Nobuhiko Hosotani, Mobara (JP); Yoshiki Nakano, Mobara (JP); Hideyuki Ohsaka, Mobara (JP)

(73) Assignees: Hitachi, Ltd., Tokyo (JP); Hitachi Device Engineering Co., Ltd., Mobara (JP)

( * ) Notice: Subject to any disclaimer, the term of this patent is extended or adjusted under 35 U.S.C. 154(b) by 0 days.

(21) Appl. No.: 09/499,515

(22) Filed: Feb. 9, 2000

(51) Int. Cl.[7] ..... H01J 29/07

(52) U.S. Cl. ..... 313/402; 313/403; 313/407; 313/408

(58) Field of Search ..... 313/402, 403, 313/404, 405–408

(56) References Cited

U.S. PATENT DOCUMENTS 4,475,056 A * 10/1984 Hirai ..... 313/402
4,743,795 A * 5/1988 Thoms ..... 313/402
5,592,044 A * 1/1997 Ohtake et al. ..... 313/402
5,730,887 A * 3/1998 Simpson et al. ..... 216/12
5,856,725 A * 1/1999 Ueda ..... 313/402
5,917,273 A * 6/1999 Watanabe et al. ..... 313/402
5,990,607 A 11/1999 Tseng et al. ..... 313/407
6,043,595 A * 3/2000 Yokoyama et al. ..... 313/402
6,072,270 A * 6/2000 Hu et al. ..... 313/402
6,114,803 A * 9/2000 Hosotani ..... 313/461

FOREIGN PATENT DOCUMENTS

JP 07192644 A * 7/1995 ..... H01J/29/07
JP 2001052606 A * 2/2001 ..... H01J/9/14

* cited by examiner

*Primary Examiner*—Ashok Patel
*Assistant Examiner*—Sikha Roy
(74) *Attorney, Agent, or Firm*—Antonelli, Terry, Stout & Kraus, LLP

(57) ABSTRACT

In a shadow mask color cathode ray tube, its shadow mask is not easily deformed into a concave shape when an impact or a vibration is applied to the shadow mask, so that a good image can be displayed. The electron beam passing holes of the shadow mask are each formed of an upper hole etched from the panel side of the shadow mask and a lower hole etched from the electron-gun side of the shadow mask. In each electron beam passing hole located in the peripheral portion of the shadow mask, the ratio of an upper-side etching quantity to a lower-side etching quantity is controlled to be 1.8 or less. By adjusting the balance in strength relative to compressive stresses between the panel side and the electron-gun side of the shadow mask, it is possible to prevent the shadow mask from being deformed into a concave shape.

11 Claims, 9 Drawing Sheets

SHADOW MASK HAVING PARTICULAR DESIGN OF UPPER AND LOWER HOLES FOR IMPROVED STRENGTH AND HALATION CHARACTERISTICS

BACKGROUND OF THE INVENTION

The present invention relates to a cathode ray tube to be used for producing a color video display and, more particularly, to a shadow mask color cathode ray tube for displaying a high resolution image.

To obtain a high-resolution color cathode ray tube, it is necessary to reduce the hole pitch of a shadow mask. However, if the hole pitch of a shadow mask is reduced, the thickness of the shadow mask becomes small, so that the strength of the shadow mask in particular becomes a problem.

To cope with this problem, a technique is disclosed in Japanese Patent Laid-Open No. 172141/1985 in which the sizes of the obverse and reverse holes of each aperture of a shadow mask are made to be approximately equal to each other, thereby increasing the equivalent thickness of the shadow mask, so as to increase the mechanical strength of the shadow mask.

In addition, to prevent halation, a shadow mask has been proposed which has a peripheral portion in which the sizes of panel-side apertures are enlarged.

Japanese Patent Publication Nos. 2696/1980 and 2697/1980 describe electron beam passing holes each having a large hole which is formed in such a manner that a diameter taken in a radial direction of the shadow mask is larger than a diameter taken along a periphery of the shadow mask. In accordance with the description of each of Japanese Patent Publication Nos. 2696/1980 and 2697/1980, the mechanical strength of the shadow mask is improved in the peripheral portion. Japanese Patent Publication Nos. 2696/1980 and 2697/1980 also describe the art of deviating a small hole with respect to a large hole toward the center of the Shadow mask.

Japanese Patent Laid-Open No. 185807/1996 (U.S. Pat. No. 5,730,887) discloses that, in the peripheral portion of a shadow mask, aperture portions formed on the electron-gun side of the shadow mask have an elongate elliptical shape extending in the direction of the incident electron beams, while aperture portions formed on the screen side of the shadow mask are deviated with respect to the aperture portions formed on the electron-gun side of the shadow mask.

Japanese Patent Laid-Open No. 10335/1992 discloses that electron beam passing holes each having an elliptical aperture on the panel side of a shadow mask and a circular aperture on the electron-gun side of the shadow mask are formed in the peripheral portion of the shadow mask.

However, there has not yet been a flat shadow mask which can compatibly satisfy requirements of both strength and halation characteristics.

FIG. 11 is a cross-sectional view of an electron beam passing hole located in the central portion of a shadow mask (hereinafter referred to as the central electron beam passing hole), and relates to a known cathode ray tube. As shown in FIG. 11, in the central portion of the screen, an electron beam B is made incident on the shadow mask at approximately right angles.

FIG. 12 is a cross-sectional view of an electron beam passing hole located in the peripheral portion of a shadow mask (hereinafter referred to as the peripheral electron beam passing hole), and relates to a known cathode ray tube. In the peripheral portion of the screen, an electron beam B is made incident at an angle A on the electron beam passing hole of the shadow mask (the angle A will be hereinafter referred to simply as the electron beam angle).

In the peripheral electron beam passing hole, a central axis CH1 of the aperture of its panel-side hole (hereinafter referred to as the upper hole) and a central axis CH2 of the aperture of its electron-gun-side hole (hereinafter referred to as the lower hole) are deviated from each other. This is intended to prevent the problem of an electron beam colliding against a slant inner surface 21 of the upper hole, whereby an electron beam B1 is reflected and scattered toward the fluorescent-screen to cause the deterioration of a display image (so-called halation).

In addition, in the electron beam passing hole, the upper hole is formed to be larger than the lower hole in order to prevent an electron beam B2 reflected by a side wall of the lower hole from striking the fluorescent screen (so-called halation). Reducing the etching quantity of the lower hole has been considered to be indispensable for preventing halation. Incidentally, the term "etching quantity" represents the volume by which the material of the shadow mask is removed by etching.

If an acceleration is applied to the whole of this shadow mask from the electron-gun side toward the panel side, compressive stresses acting toward the center of the shadow mask are produced in the shadow mask having a radius of curvature which is convex on the panel side. In the conventional shadow mask, the panel-side etching quantity is larger than the electron-gun-side etching quantity, but since the radius of curvature is small, concave deformation can be restrained. However, the following relationship becomes conspicuous; as the radius of curvature of a shadow mask becomes larger, the mechanical strength of the panel side of the shadow mask becomes less resistant to compressive stress than that of the electron-gun side of the shadow mask. As a result, the shadow mask becomes easily deformed into a concave shape, so that it is difficult to maintain the mechanical strength of the shadow mask to a sufficient extent.

SUMMARY OF THE INVENTION

An object of the present invention is to restrain a shadow mask which is convex toward a panel side from being deformed into a concave shape when a compressive stress is applied to the shadow mask toward the center of the shadow mask, thereby realizing a mechanical strength capable of maintaining the convex shape.

To achieve the foregoing object, the present invention provides a cathode ray tube which is constructed as follows.

A shadow mask includes electron beam passing holes each having circular aperture shapes on both a panel side and an electron-gun side, and the ratio of an etching quantity on the electron beam exit side (panel side) of the central plane of the thickness of the shadow mask (hereinafter referred to simply as the upper-side etching quantity) to an etching quantity on the electron beam entrance side (electron-gun side) of the central plane of the thickness of the shadow mask (hereinafter referred to as the lower-side etching quantity) is 1.8 or less.

In addition, in each electron beam passing hole located in proximity to a imperforate area, the aperture shape of its upper hole is an elliptical shape having a longer diameter extending in a radial direction of the shadow mask, and a shorter diameter of the elliptical shape is made smaller than the diameter of the upper hole of each electron beam passing hole located in the central portion of the shadow mask.

DESCRIPTION OF THE PREFERRED EMBODIMENTS

Figure 1:
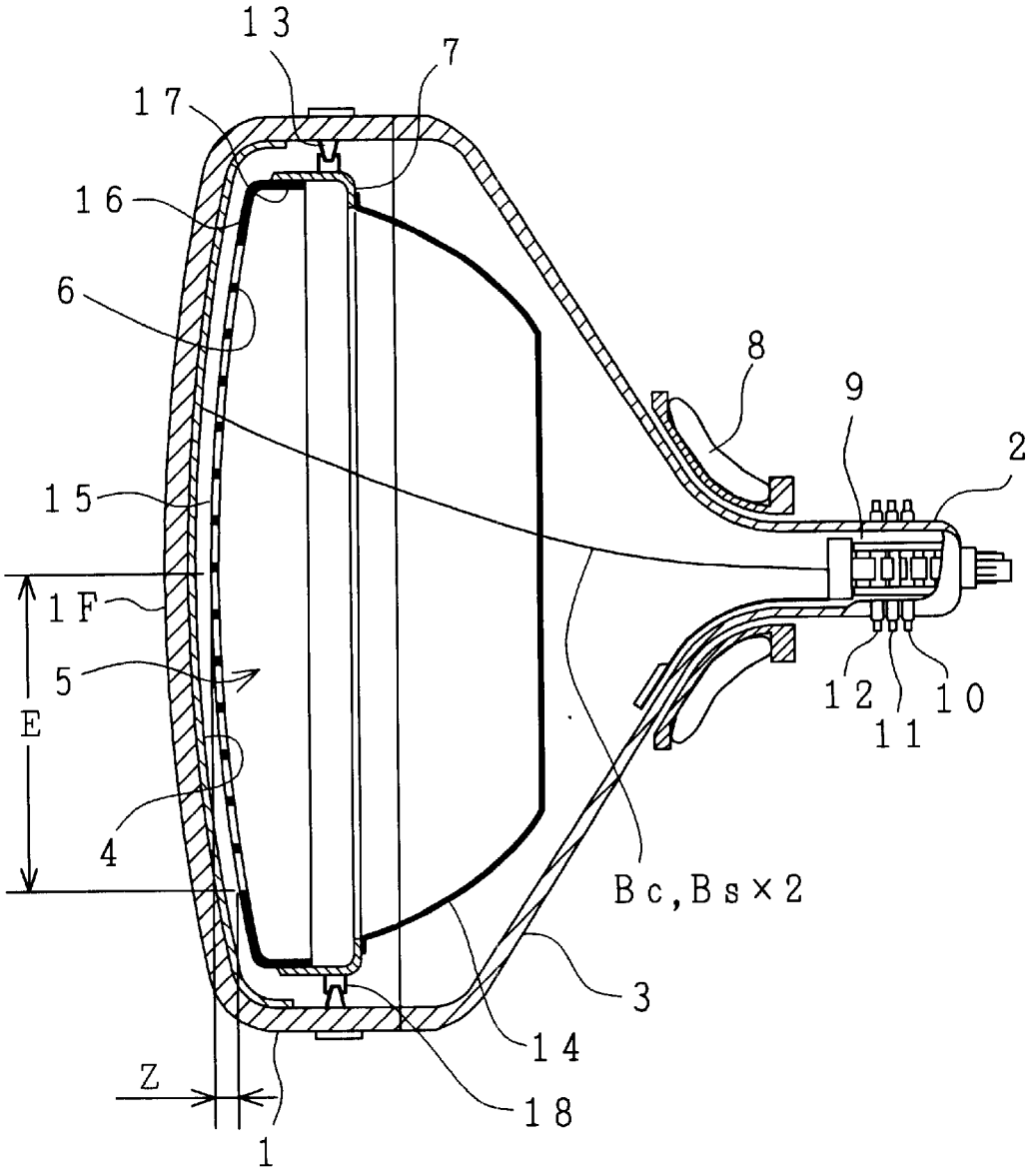
FIG. 1 is a cross-sectional view of a shadow mask type color cathode ray tube according to the present invention.

FIG. 1 is a cross-sectional view of a 19-inch type (46-cm type) color cathode ray tube according to the present invention, showing a panel 1 having a fluorescent screen 4 on its inner surface, a neck 2 which houses an inline electron gun 9, and a funnel 3 which connects the panel 1 and the neck 2. A magnetic shield 14 is disposed in the color cathode ray tube.

A magnet group disposed outside the neck 2 includes a purity adjustment magnet 10 and static convergence adjustment magnets 11 and 12, which are used for adjusting the color purity and convergence of the color cathode ray tube.

A deflection device 8 for deflecting three electron beams B emitted from the electron gun 9 is attached to the outside of the transition area between the neck 2 and the funnel 3. These three electron beams pass through a shadow mask structure 5 arranged inside the panel 1, and respectively strike on red, green and blue fluorescent layers to cause the corresponding phosphors to luminesce.

The shadow mask structure 5 includes a shadow mask 6 having electron beam passage holes for screening electron beams, and a support frame 7 which supports the shadow mask 6.

Springs 18 are fixed to the support frame 7. The shadow mask structure 5 is arranged inside the color cathode ray tube by the holes of springs 18 being fitted to stud pins 13 located inside the panel 1.

Figure 2A:
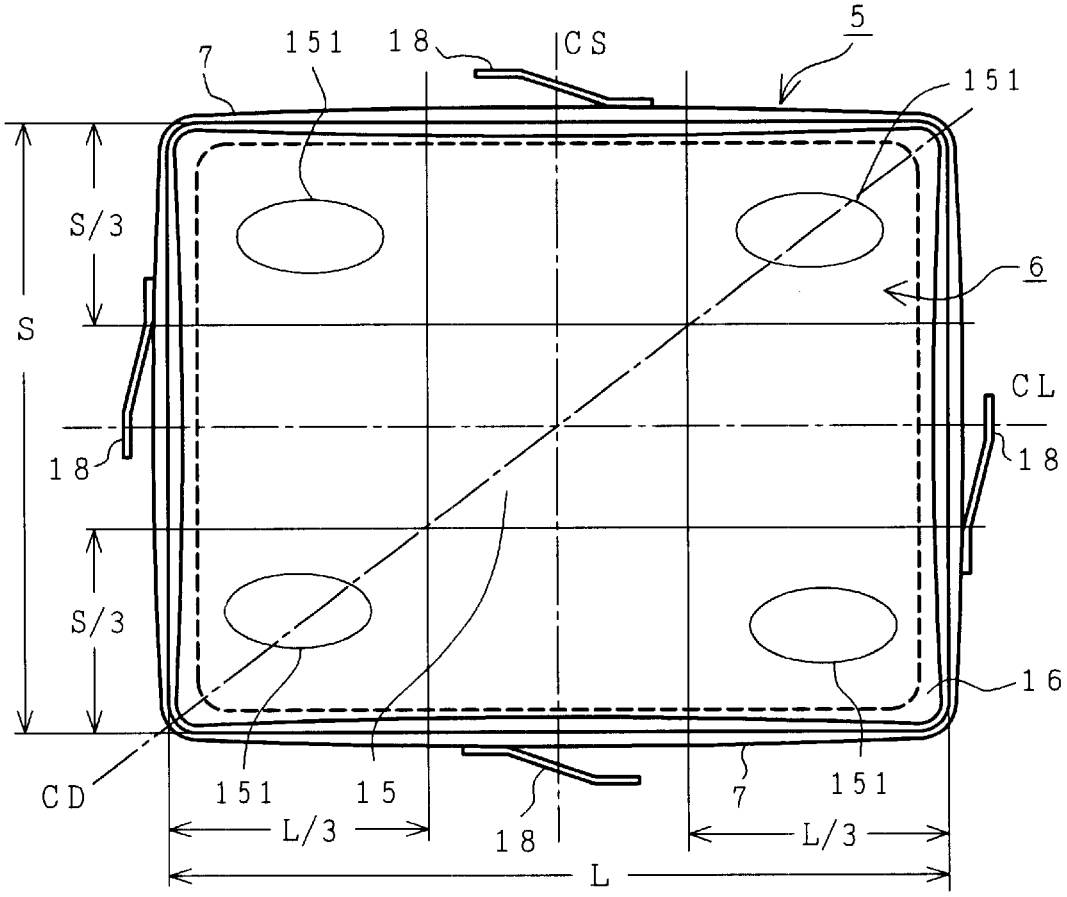
FIG. 2A is a front view of the shadow mask structure shown in FIG. 1.
Figure 2B:
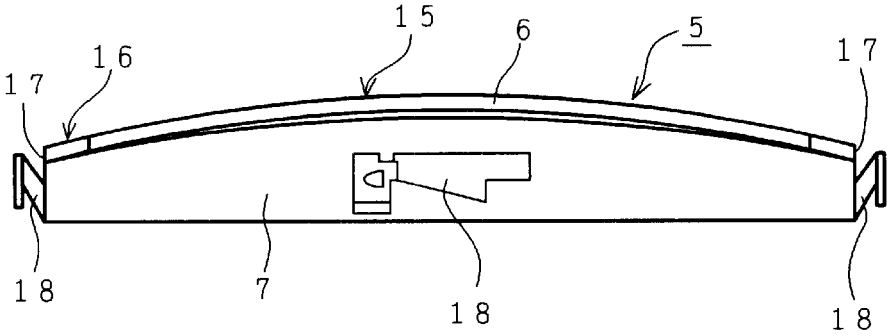
FIG. 2B is a side view of the shadow mask structure.

FIG. 2A is a view as seen from the face-plate side of the shadow mask structure 5 provided in the cathode ray tube according to the present invention. FIG. 2B is a side view of the shadow mask structure 5. In FIGS. 2A and 2B, the same portions as those shown in FIG. 1 are denoted by the same reference numerals.

In FIGS. 2A and 2B, the portion inside a dashed line is a perforated portion 15 of approximately rectangular shape in which a multiplicity of electron beam passing holes (not shown) are disposed. A imperforate portion 16 is disposed to surround the perforated portion 15. The imperforate portion 16 is partly bent in a direction parallel to the tube axis of the cathode ray tube, to form a skirt portion 17. The shadow mask 6 is welded to the support frame 7 of approximately rectangular shape at the skirt portion. In FIG. 2A, a longer axis CL represents an imaginary center line which passes through the centers of the shorter sides of the shadow mask, a shorter axis CS represents an imaginary center line which passes through the centers of the longer sides of the shadow mask, and a diagonal line CD represents an imaginary line which connects the diagonal corners of the shadow mask. The intersection of the longer axis CL and the shorter axis CS is the center of the shadow mask and is located on the tube axis of the cathode ray tube.

When a compressive stress is applied to the shadow mask, part of the perforated portion is easily deformed into a concave shape. After the concave shape has occurred, this deformation returns to the original concave shape, but trace of bent portions remains. There is also a case where this deformation is an elastic deformation.

The results of experiments and simulations made by the present inventor have shown that the perforated portion is easily deformed into a concave shape in areas each of which is parallel to the shorter axis CS and extends by a ⅓ length of each longer side L of the shadow mask from the corresponding corner of the same. In addition, the perforated portion is easily deformed into a concave shape in areas each of which is parallel to the longer axis CL and extends by a ⅓ length of each shorter side S of the shadow mask from the corresponding corner of the same. Areas 151 close to the respective corners are particularly easily deformed because each of the areas 151 is an area which is defined by a ⅓ length of one of the longer sides L from the corresponding corner of the shadow mask and a ⅓ length of one of the shorter side S from the same corner.

The deformation of the shadow mask can be restrained by applying the present invention (to be described below) to the perforated area.

Figure 3:
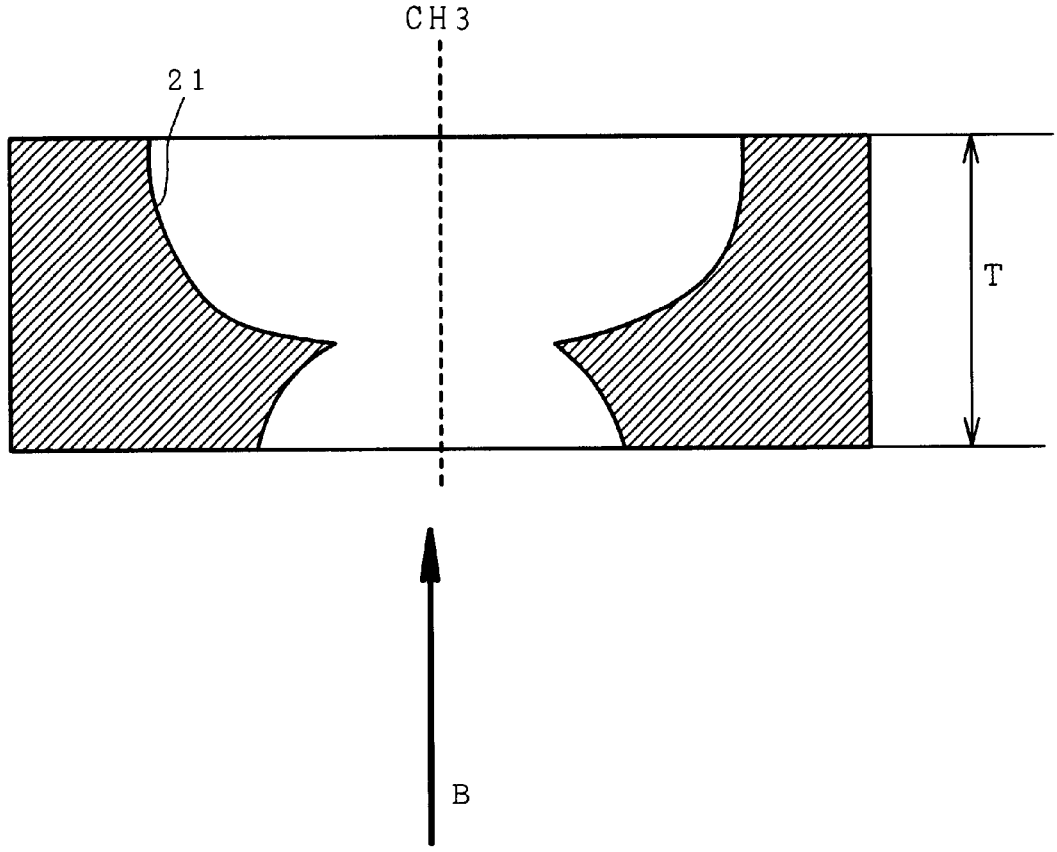
FIG. 3 is a cross-sectional view of an electron beam passing hole in a central portion of a shadow mask according to the present invention.

FIG. 3 is a partial cross-sectional view of an aperture of the shadow mask provided in the cathode ray tube according to the present invention, more particularly, a cross-sectional view of an electron beam passing hole located in the center of the perforated portion 15. In the vicinity of the center of the perforated portion of the shadow mask, electron beams are made incident on the shadow mask almost without being deflected. For this reason, the problem of halation due to a side wall 21 of an upper hole hardly occurs, and a central axis CH3 of the upper hole and that of a lower hole coincide with each other.

Figure 4A:
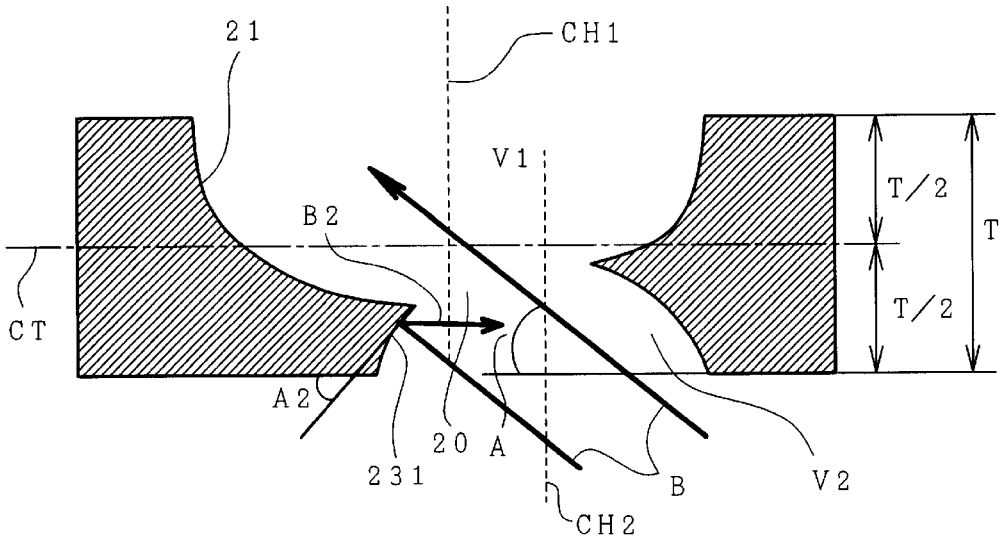
FIG. 4A is a cross-sectional view of a first embodiment of the present invention, showing an electron beam passing hole located in the peripheral portion of the shadow mask.

A first embodiment of the present invention will be described below with reference to FIG. 4A. FIG. 4A is a partial cross-sectional view of an aperture of the shadow mask which is provided in the cathode ray tube according to the present invention, more particularly, a cross-sectional view of an electron beam passing hole located on the diagonal line CD at a location which is 10 mm away from the boundary between the imperforate portion and the perforated portion toward the center of the shadow mask (i.e., a peripheral electron beam passing hole).

In FIG. 4A, reference numeral V1 denotes the quantity of etching which is effected on the fluorescent-screen side of an imaginary center line CT of a shadow mask thickness T (an upper-side etching quantity), while reference numeral V2 denotes the quantity of etching which is effected on the electron-gun side of the imaginary center line CT of the shadow mask thickness T (a lower-side etching quantity).

The present invention aims to prescribe the ratio of V1 to V2 and, more particularly, to prevent the deformation of the shadow mask by reducing the V1/V2 ratio.

This electron beam passing hole is formed so that the (V1/V2) ratio of the upper-side etching quantity V1 to the lower-side etching quantity V2 is 1.8 or less. The shadow mask constructed in this manner is capable of restraining the deformation of the shadow mask itself.

Preferably, by applying the present invention to the shadow mask with the etching quantity being gradually varied from the central portion toward the areas 151, it is possible to avoid locally applied stresses and restrain the deformation of the shadow mask. More preferably, by applying the present invention to the entire area of the perforated portion of the shadow mask, it is possible to eliminate an excessive variation in strength from the perforated portion and readily restrain the deformation of the shadow mask.

An outer side wall 231 of the lower hole of FIG. 4A has a surface having a tangent at an angle A2 or less with respect to the lower surface of the shadow mask, for the purpose of preventing halation due to reflection from the outer side wall 231 of the lower hole. An electron beam B having an angle A is reflected in a direction approximately parallel to a surface of the shadow mask, by the surface having the angle A2. Thus, a reflected electron beam B2 can be prevented from traveling toward the fluorescent screen.

Figure 4B:
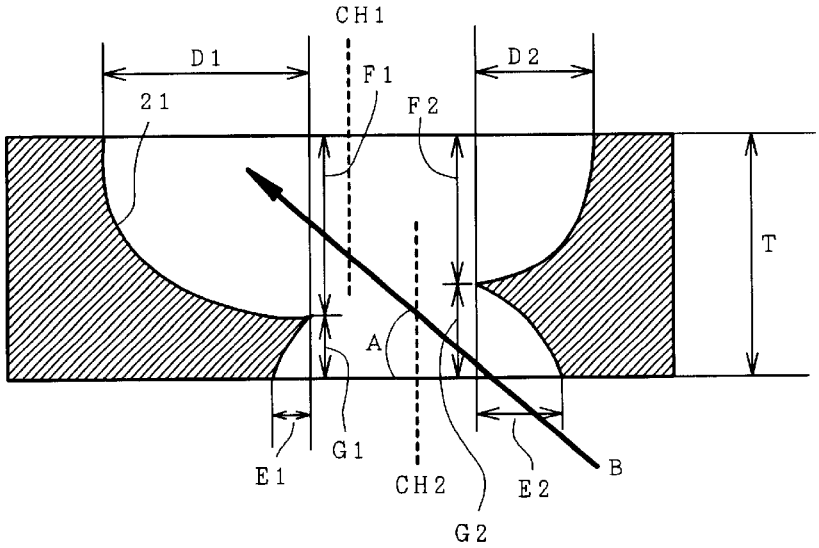
FIG. 4B is a cross-sectional view of an electron beam passing hole in which halation due to an upper hole is prevented.

FIG. 4B shows a structure for preventing halation due to a side wall 21 of the upper hole of the electron beam passing hole.

In FIG. 4B, a lower hole central axis CH2 and an upper hole central axis CH1 are deviated for the purpose of preventing halation and the quantity of the deviation is 0.03–0.05 mm. A height G1 and a height G2 of the connection portion between the lower hole and the upper hole differ between the peripheral side and the central side of the shadow mask.

A diameter (upper-hole outer side wall diameter) D1 of the outer side wall of the upper hole, which diameter D1 is parallel to the upper surface of the shadow mask, a diameter (lower-hole outer side wall diameter) E1 of the outer side wall of the lower hole, which diameter E1 is parallel to the lower surface of the shadow mask, a diameter (lower-hole central side wall diameter) E2 of the central side wall of the lower hole, which diameter E2 is parallel to the lower surface of the shadow mask, the thickness T and the electron beam angle A are selected to have the relationship of (D1+E2) tan A≧T. In addition, since each electron beam passing hole located in the peripheral portion of the shadow mask is formed to satisfy the relationship D1 tan A≧F1, it is possible to prevent the electron beam B from colliding against the side wall 21 and traveling toward the fluorescent screen.

Moreover, a central side wall diameter E2 of the lower hole, the height (lower-hole central side wall height) G2 of the central side wall of the lower hole, which height G2 is parallel to a lower hole central axis CH2, the thickness T and the electron beam angle A are selected to have the relationship of E2 tan A≧G2.

Since each peripheral electron beam passing hole is formed to have the relationship of (D1+E2) tan A≧T. D1 tan A≧F1 or E2 tan A≦G2, it is possible to prevent the electron beam B from colliding against the side wall 21 and traveling toward the fluorescent screen.

The height (lower-hole outer side wall height) G1 of the outer side wall of the lower hole, which height G1 is parallel to the lower hole central axis CH2, is lower than the lower-hole central side wall height G2. A height (upper-hole outer side wall height) F1 of the outer side wall of the upper hole, which height F1 is parallel to the upper hole central axis CH1, is higher than a height (upper-hole central side wall height) F2 of the central side wall of the upper hole, which height F2 is parallel to the upper hole central axis CH1.

In the cathode ray tube according to the present invention, by setting the (G1/T) ratio of the outer side wall height G1 of the lower hole to the thickness T of the shadow mask to 0.20 or more, it is possible to improve the mechanical strength of the peripheral portion of the shadow mask and also to restrain halation due to the side wall 21.

Figure 5:
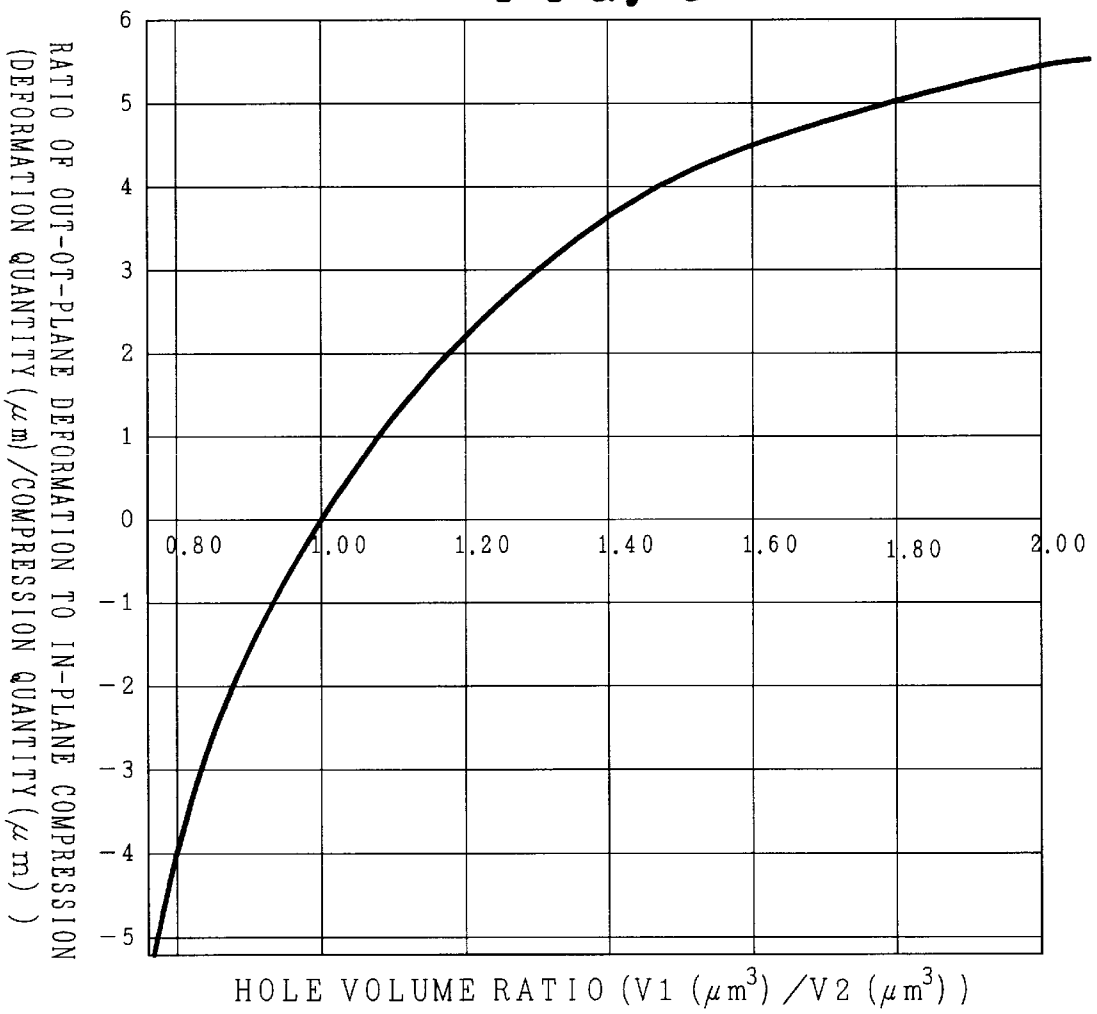
FIG. 5 is a graph showing the volume ratio of an electron beam passing hole and the deformation ratio of a shadow mask.

FIG. 5 is a graph concerning the V1/V2 ratio and the rigidity of the shadow mask in a corner portion of the perforated portion. Each measured sample was extracted from an area 10 mm away from the boundary between the imperforate portion and the perforated portion in the corner portion, and had a longitudinal size of 0.630 mm, a lateral size of 0.675 mm and a thickness of 0.13 mm.

In FIG. 5, the horizontal axis represents the (V1/V2) ratio of the etching quantity V1 ($\mu m^3$) to the etching quantity V2 ($\mu m^3$) (hereinafter referred to as the volume ratio), while the vertical axis represents the (deformation quantity/compression quantity) ratio of a deformation quantity ($\mu$m) perpendicular to the surface to a compression quantity ($\mu$m) parallel to the surface (hereinafter referred to as the deformation ratio).

A total of four kinds of samples were used, and the (V1/V2) ratio of a sample 1 was 1.97, the (V1/V2) ratio of a sample 2 was 1.47, the (V1/V2) ratio of a sample 3 was 1.09 and the (V1/V2) ratio of a sample 4 was 0.88. The upward and downward deformation quantities of each of the samples were measured while it was being deformed by 0.1 $\mu$m in a direction parallel to the surface. The direction of compression is a radial direction of the shadow mask, and a plus (+) sign represents the case in which each of the samples was deformed toward the electron gun. Incidentally, the electron beam passing hole of the shadow mask of each of the samples 1 to 4 has a circular aperture shape of diameter 0.2 mm on its panel side.

As the volume ratio (V1/V2) becomes smaller, the downward deformation quantity of the shadow mask with respect to the compression of the same due to impact becomes smaller. Since the downward deformation quantity of the shadow mask decreases, it is possible to prevent the shadow mask from being deformed into a concave shape. In terms of the rigidity ratio of the shadow mask, when the deformation ratio of the vertical axis is set to 5 or less, the rigidities of the upper and lower sides of the shadow mask can be balanced well. Accordingly, even if an instantaneous compressive force is applied to a dome type of shadow mask in a direction parallel to the surfaces thereof, the deformation of the shadow mask can be restrained.

When the electron gun- and panel-side apertures of the electron beam passing hole are circular, a curve as shown in FIG. 5 is obtained. From this curve it is seen that, when the (V1/V2) volume ratio is 1.8 or less, the deformation ratio is 5 or less, so that it is possible to obtain a shadow mask having a balanced mechanical strength which can withstand an impact due to a fall.

If the (V1/V2) volume ratio is less than 0.8, the deformation ratio varies to a great extent even with a small etching quantity, so that it becomes difficult to control the rigidity of the upper side and the rigidity of the lower side by means of the upper-side etching quantity V1 and the lower-side etching quantity V2. For this reason, it is preferable to set the (V1/V2) volume ratio within the range of $0.8 \leqq (V1/V2) \leqq 1.8$.

More preferably, the mechanical strength is set within a range in which the deformation ratio is small, that is to say, the range of $-2 \leqq$(deformation quantity/compression quantity)$\leqq 2$. Specifically, when the volume ratio is set within the range of $0.89 \leqq (V1/V2) \leqq 1.22$, the mechanical strength of the shadow mask increases.

Since the shadow mask has a dome-like shape, no convex-like deformation easily occurs in the fluorescent-screen side of the shadow mask with respect to compressive forces acting in directions parallel to the surfaces.

The volume of a hole formed by etching can be found by the following method.

An optical microscope or a scanning electron microscope is used to take a stereoscopic photograph of the fluorescent-screen side of a shadow mask, thereby finding the volume of an upper hole. As to the electron-gun side of the shadow mask as well, the volume of a lower hole is found in a similar way. In this case, the volumes of, preferably, ten arbitrary holes which can be viewed in the field of view of the microscope are found and the average of the volumes is calculated.

Incidentally, after a replica of a hole of a shadow mask is produced, the volume of the projecting portion of the replica may be calculated by a method similar to the above-described one.

Figure 6:
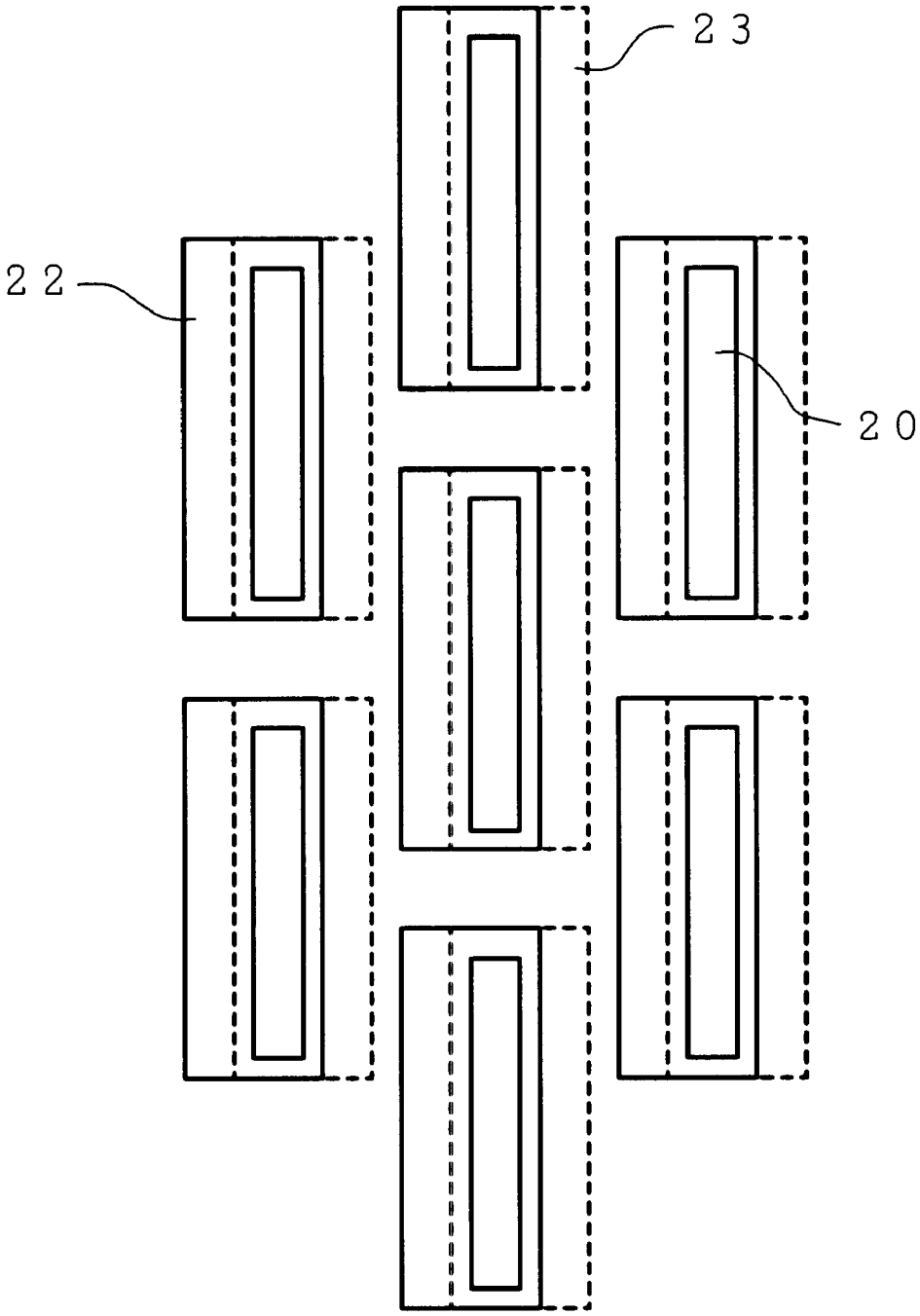
FIG. 6 is a view of the layout of electron beam passing holes in a slit-type shadow mask.

Although, in the above description of the embodiment, reference has been made to a dot type of color cathode ray tube, the invention may be applied to a color cathode ray tube using a slit type of shadow mask as shown in FIG. 6. FIG. 6 is a partial enlarged view of the shadow mask, more specifically, the left-side portion of the shadow mask that is close to the longer axis CL.

Figure 7A:
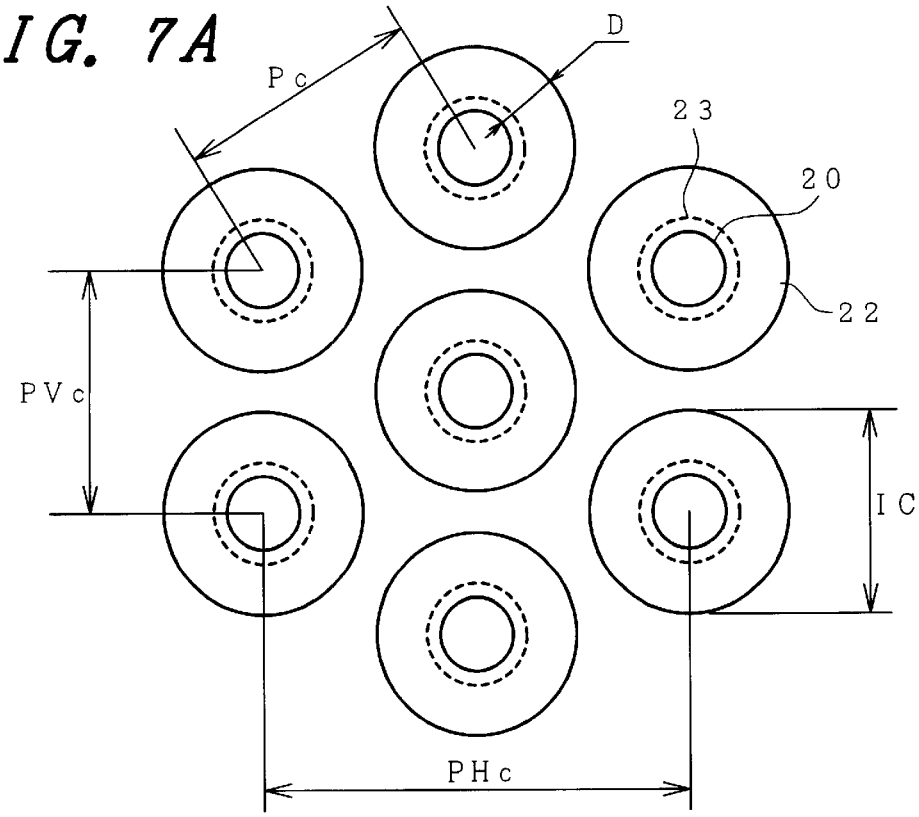
FIG. 7A is a diagrammatic view of a second embodiment of the present invention, showing electron beam passing holes in the central portion of a shadow mask.
Figure 7B:
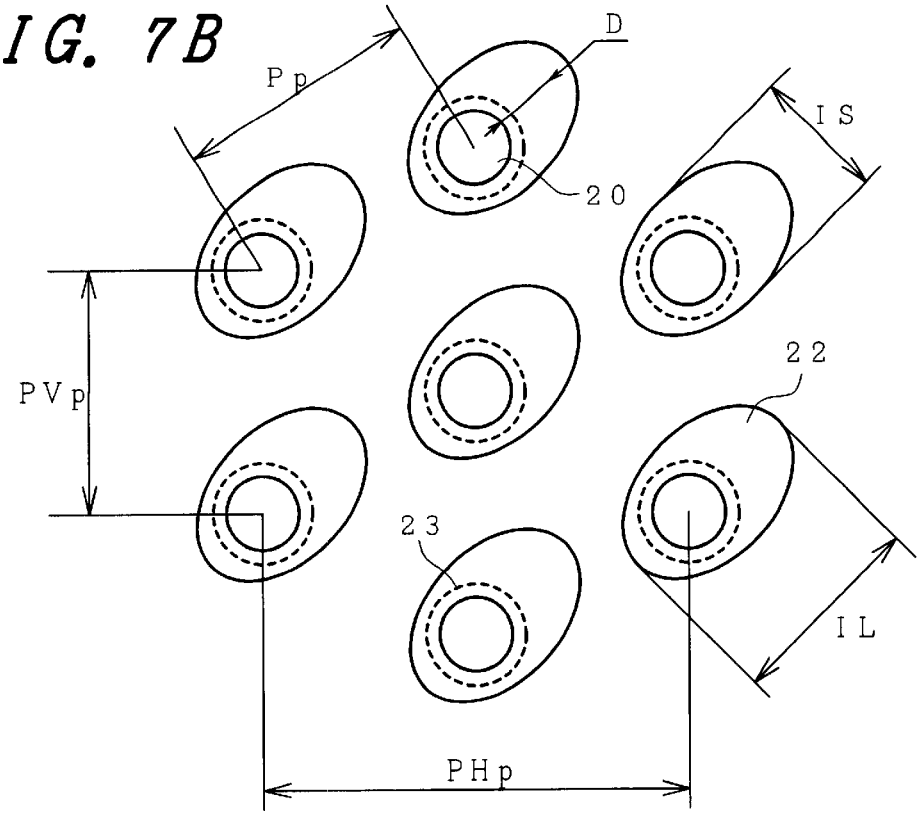
FIG. 7B is a diagrammatic view of a the second embodiment of the present invention, showing electron beam passing holes in the peripheral portion of a shadow mask.

FIGS. 7A and 7B are views showing electron beam passing holes of a second embodiment of the present invention, more specifically, partial enlarged views of a dot type of shadow mask. In FIGS. 7A and 7B, a solid line represents an upper hole 22, and a dashed line represents a lower hole 23. A connecting hole 20 is formed in the connection portion between the upper hole 22 and the lower hole 23.

FIG. 7A is a partial enlarged view of electron beam passing holes formed in the vicinity of the center of the shadow mask.

In the vicinity of the center of the perforated portion of the shadow mask, since electron beams are made incident on the shadow mask almost without being deflected, the problem of halation due to the side wall 21 of the upper hole 22 hardly occurs. Accordingly, there is no need to enlarge the side wall diameter, D, of the upper hole 22 of the electron beam passing hole. In addition, in terms of the strength of the central portion of the shadow mask, the side wall diameter, D, of the upper hole 22 is made small, and the diameter, IC, of the aperture of the upper hole 22 is made smaller than the pitch, Pc, of adjacent electron beam passing holes.

For example, in the central portion of the shadow mask, a vertical pitch PVc is 0.27 mm, a horizontal pitch PHc is 0.42 mm, the aperture shape of the upper hole 22 is a circle whose diameter IC is 200 $\mu$m, and the aperture shape of the lower hole 23 is a circle whose diameter IC is 120 $\mu$m.

FIG. 7B is a partial enlarged view of the vicinity of the top right corner of the shadow mask according to the present invention. In FIG. 7B, the respective centers of the lower holes 23 are deviated toward the center of the shadow mask from the centers of the upper holes 22. This construction solves the problem of halation due to reflection from the side walls 21 of the upper holes 22.

The apertures of the upper holes 22 are approximately elliptical, and the longer axes of the respective ellipses extend in radial directions of the shadow mask. In FIG. 7B, symbol IL denotes the longer-axis diameter of each of the ellipses (hereinafter referred to as the longer diameter), and symbol IS denotes the shorter-axis diameter of the same (hereinafter referred to as the shorter diameter).

Referring to a specific example, the aperture shape of each upper hole in the peripheral portion of the shadow mask is such that the longer diameter IL is 200 $\mu$m and the shorter diameter IS is 160 $\mu$m. The shorter diameter IS has a length which is 80% of the diameter of the aperture of each upper hole in the vicinity of the center of the shadow mask, so that the etching quantity of each upper hole in the vicinity of the periphery of the shadow mask can be reduced. In addition, since the apertures of the upper holes can be made elliptical, it is possible to obtain a shadow mask having a good strength balance.

In this shadow mask, the aperture shape of each lower hole in the peripheral portion is a circle of diameter 130 $\mu$m. By enlarging the lower holes in the peripheral portion of the shadow mask, it is possible to make the lower holes of the shadow mask non-resistant to compressive stresses in the radial direction and, at the same time, it is possible to enlarge the electron beam passing holes, thereby making it possible to improve the brightness of the peripheral portion of the screen.

Incidentally, the deformation ratio of this shadow mask is 1.69, and the balance between the rigidity of the upper side and the rigidity of the lower side is good.

In the peripheral portion of the shadow mask, a vertical pitch PVp is 0.27 mm and a horizontal pitch PHp is 0.45 mm.

In order to make the shadow mask smaller in radius of curvature than the inner surface of the panel or to obtain a landing margin for electron beams in the peripheral portion of the shadow mask, the vertical pitch PVp in the peripheral portion of the shadow mask is made larger than the vertical pitch PVc in the central portion of the same, or the horizontal pitch PHp in the peripheral portion of the shadow mask is made larger than the horizontal pitch PHc in the central portion of the same. Accordingly, a pitch Pp of adjacent electron beam passing holes in the peripheral portion is larger than the central pitch Pc. Otherwise, the vertical pitch PVp and the horizontal pitch PHp in the peripheral portion of the shadow mask may be made equal to the vertical pitch PVc and the horizontal pitch PHc in the central portion of the same, respectively.

Since the apertures of the upper holes have the shape of an ellipse having a longer axis extending in a radiation direction, the shadow mask has a structure which can resist compressive stresses in the radiation directions. Owing to this structure, the shadow mask is capable of restraining concave deformation and readily maintaining its upward convex shape.

The shorter diameter IS is smaller than the diameters IC of the apertures of the upper holes in the central portion. The shorter diameter IS is formed to have a length which is 90% or less of the diameter of the aperture of the upper hole of each central electron beam passing hole. By reducing the shorter diameter of the ellipse, the upper holes of the shadow mask become resistant to radial compressive stresses.

In case the pitch of the shadow mask is equal between the peripheral portion and the central portion or larger in the peripheral portion than in the central portion, there are various structures for making the upper holes elliptical. In the present invention, the shorter diameters of the elliptical upper holes are made smaller than the diameters of the central upper holes in terms of the balance in rigidity between the upper holes and the lower holes of the shadow mask.

Preferably, the second embodiment may be applied to the easily deformable areas described above in connection with FIG. 2A.

More preferably, the shorter diameters IS may be made gradually smaller from the center of the shadow mask toward the periphery thereof so that the deformation of the peripheral portion of the shadow mask can be restrained and locally applied stresses can be avoided to restrain the deformation of the shadow mask.

Moreover, it is desirable that the shorter diameter IS of the aperture of each of the upper holes in the peripheral portion be at least 65% or more of the diameter of the aperture of each of the upper holes in the central portion in order to maintain the passing ratio of electron beams of the shadow mask.

In addition, to improve the passage ratio of electron beams, the longer diameters of the ellipses may be made larger as the shorter diameters are made smaller. In this case as well, to make the upper holes of the shadow mask resistant to compressive stresses in the radial directions, it is preferable to reduce the shorter diameters IS to lengths which are 90% to 65% of the longer diameters IL. According to this construction, the brightness of the corner portions of the screen can be improved.

Figure 8:
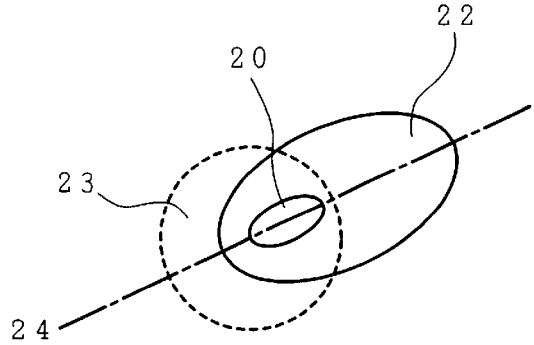
FIG. 8 is a diagram showing another shape of an electron beam passing hole in the second embodiment of the present invention.

FIG. 8 is a view showing a construction in which the lower hole 23 is enlarged to increase the lower-side etching quantity. In this case, the rigidity of the lower side becomes weak, whereby it is possible to restrain the shadow mask from being deformed into a concave shape by radial compressive stresses.

The connecting hole 20 shown in FIG. 8 has an elliptical shape having a longer axis 24 extending in a radial direction of the shadow mask. According to this construction, the shadow mask becomes resistant to compressive stresses in the radial directions.

Figure 9A:
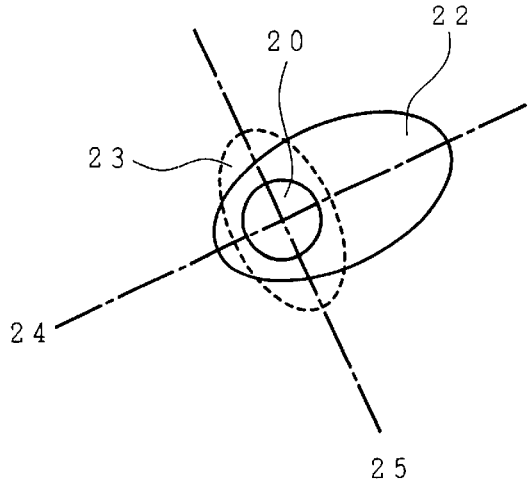
FIG. 9A is a diagram showing another shape of an electron beam passing hole in the second embodiment of the present invention.

FIG. 9A is a view showing an electron beam passing hole of another shadow mask according to the present invention. The aperture of the upper hole 22 of the electron beam passing hole has an elliptical shape, and the longer axis 24 of this ellipse extends in a radial direction of the shadow mask. The aperture of the lower hole 23 of the electron beam passing hole has an elliptical shape, and a longer axis 25 of the lower-hole ellipse extends in a direction perpendicular to the longer axis 24 of the upper-hole ellipse.

Since the upper hole 22 has an elliptical shape having the longer axis 24 extending in the radial direction, the upper hole 22 has a structure resistant to compressive stresses in radial directions. Since the lower hole 23 has an elliptical shape having the longer axis 25 perpendicular to the longer axis 24 of the upper-hole ellipse, the lower hole 23 has a structure which is not resistant to compressive stresses in radial directions. In other words, the shadow mask differs in rigidity between the upper and lower holes with respect to a compressive stress acting in the same direction. In accordance with the present invention, it is possible to restrain plastic deformation of the shadow mask when the shadow mask receives a compressive force in a direction parallel to the surface. Specifically, by adjusting the balance in strength relative to compressive stresses between the panel side and the electron-gun side of the dome-shaped shadow mask, it is possible to prevent the shadow mask from being deformed into a concave shape.

Particularly when the longer diameter of the lower-hole aperture is larger than the shorter diameter of the upper-hole aperture, the shadow mask becomes non-resistant to compressive stresses in radial directions, whereby the deformation of the shadow mask can be restrained.

In addition, even if the upper-hole aperture is made circular and the lower-hole aperture is given an elliptical shape having a longer axis extending along the tangential direction, it is possible to adjust the balance in strength relative to compressive stresses between the panel side and the electron-gun side of the dome-shaped shadow mask.

Figure 9B:
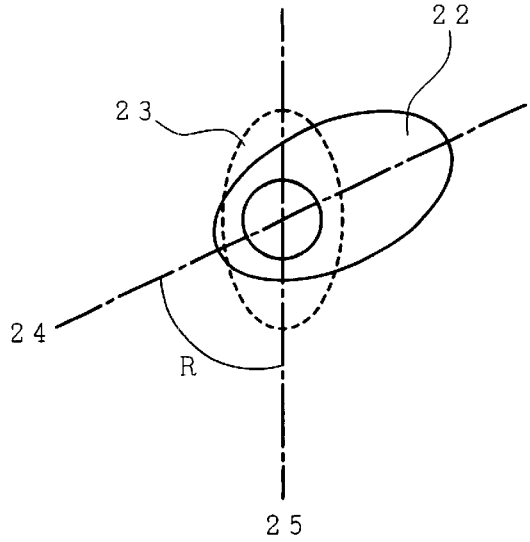
FIG. 9B is a diagram showing another shape of an electron beam passing hole in the second embodiment of the present invention.

The structure shown in FIG. 9A can best withstand compressive stresses acting in the radiation directions of the shadow mask, but the structure shown in FIG. 9B also has the capability to withstand compressive stresses acting in the radial directions of the shadow mask.

Similarly to the upper hole 22 shown in FIG. 9A, the aperture of the upper hole 22 shown in FIG. 9B has a structure resistant to compressive stresses acting in the radial directions. The aperture of the lower hole 23 has an elliptical shape having the longer axis 25 extending in a direction deviated by an angle R from the longer axis 24 of the upper-hole ellipse. In other words, the direction in which the upper hole becomes most resistant to compressive stresses differs from the direction in which the lower hole becomes most resistant to compressive stresses.

In each of the embodiments shown in FIGS. 7B, 8, 9A and 9B, either or both of the upper and lower holes are formed to have an elliptical shape, but may also be given an elongate elliptical shape or a rectangular shape, instead of an elliptical shape. In addition, although the shape of the connecting hole 20 has been described as a circular or elliptical shape, the connecting hole 20 may also have an elliptical, elongate elliptical or rectangular shape having a longer axis extending in a radial direction of the shadow mask.

Figure 10:
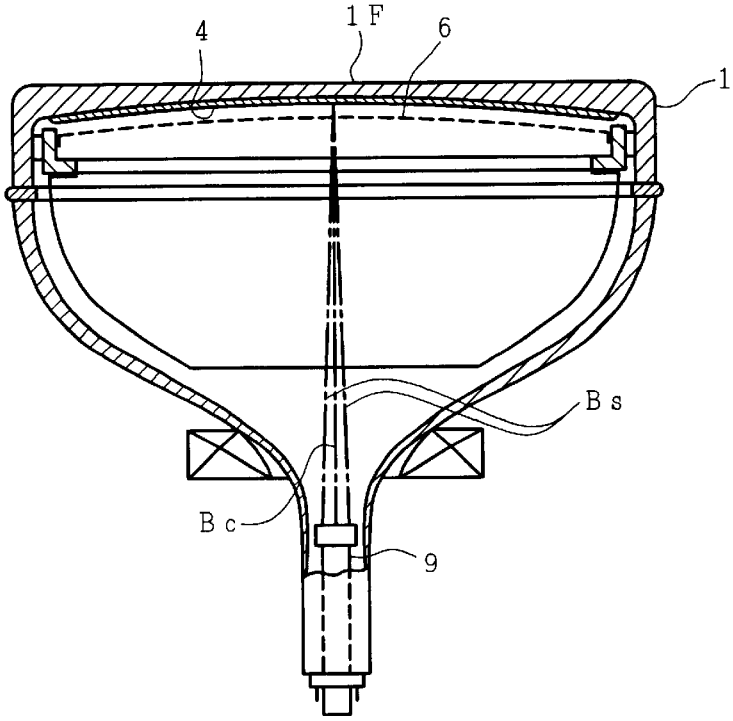
FIG. 10 is a cross-sectional view of the shadow mask type color cathode ray tube according to the present invention.
Figure 11:
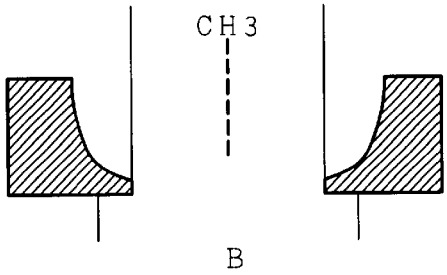
FIG. 11 is a cross-sectional view of an electron beam passing hole in the central portion of a shadow mask of a known cathode ray tube.
Figure 12:
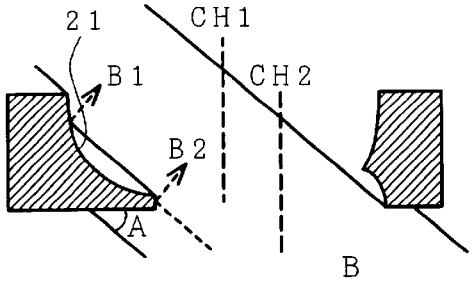
FIG. 12 is a cross-sectional view of an electron beam passing hole in the peripheral portion of the shadow mask of the known cathode ray tube.

In the color cathode ray tube shown in FIG. 10, the radius of curvature of its panel outer surface is 50,000 mm or more, and the panel outer surface appears approximately flat. The panel inner surface of the color cathode ray tube has a large radius of curvature. In addition, the radius of curvature of the shadow mask 6 of the color cathode ray tube increases according to an increase in the radius of curvature of the panel inner surface. Since the radius of curvature of the panel inner surface is large, it is possible to reduce image distortion in the color cathode ray tube having an approximately flat panel outer surface.

The shadow mask 6 shown in FIG. 10 has a thickness of about 0.10 to 0.14 mm. The shadow mask 6 has a dome-like shape which is convex toward its face plate but is considerably close to a flat shape compared to conventional shadow masks.

The shape of the shadow mask in this embodiment is an aspherical shape in which a radius of curvature taken along the longer axis CL, a radius of curvature taken along the shorter axis SC and a radius of curvature taken along the diagonal line CD each decreases gradually from the center toward the periphery of the shadow mask.

The radius of curvature of the shadow mask having such aspherical shape is defined as an equivalent radius of curvature RE as follows:

$$RE=(Z^2+E^2)/2Z,$$

where E is the distance from the center of the shadow mask to an edge position of the perforated surface, measured in a direction perpendicular to the tube axis, and Z is the amount of depression of the effective surface at a corner end position thereof from the center of the shadow mask in the direction of the tube axis.

Referring to specific numerical values, a diagonal distance ED was measured at a position which was 175 mm away from the center of the shadow mask in the direction of the longer axis and 132 mm away from the same in the direction parallel to the shorter axis. Specifically, a depression quantity ZD was about 14.9 mm at the diagonal distance ED of about 219.2 mm. The equivalent radii of curvature of the perforated portion of the shadow mask were as follows: an equivalent radius of curvature RL taken along the longer axis CL was about 1,521 mm; an equivalent radius of curvature RS taken along the shorter axis CS was about 1,856 mm; and an equivalent radius of curvature RD taken along the diagonal line CD was about 1,619 mm.

By applying the present invention to such a cathode ray tube, it is possible to readily improve the strength of the shadow mask. Particularly when the present invention is applied to a cathode ray tube in which the equivalent radius of curvature taken along the diagonal line CD of the shadow mask is 1,400 mm or more, the strength of the shadow mask can readily be improved.

For example, in a 19-inch type cathode ray tube in which the maximum deflection angle of an electron beam is 1000, the equivalent radius of curvature taken along the longer axis CL is about 1,423 mm, the equivalent radius of curvature taken along the shorter axis CS is about 2,076 mm, and the equivalent radius of curvature taken along the diagonal line CD is about 1,491 mm.

In addition, for example, in a 21-inch type (51-cm type) cathode ray tube in which the maximum deflection angle of an electron beam is 900, the equivalent radius of curvature taken along the longer axis CL is about 1,465 mm, the equivalent radius of curvature taken along the shorter axis CS is about 2,223 mm, and the equivalent radius of curvature taken along the diagonal line CD is about 1,656 mm.

The present invention, when applied to a 19-inch type CDT, can realize a great improvement. However, the strength of a shadow mask does not decrease to a great extent as long as the diagonal size (2×ED) of its perforated portion is small even if the radius of curvature R of the shadow mask is the same. Specifically, the present invention is particularly effective, in a Braun tube provided with a shadow mask in which the diagonal size (2×ED) is 360 mm or more and the value of R/2ED is 3.9 or more.

By applying any of the embodiments to such a shadow mask, it is possible to provide a cathode ray tube provided with a shadow mask having good strength.

In addition, if the shadow mask is formed of an Fe—Ni—Co alloy, the mechanical strength can be improved to a further extent.

Although the second embodiment of the present invention has been described above, the first embodiment of the present invention can, of course, be applied to the color cathode ray tube shown in FIG. 10. In addition, the first embodiment and the second embodiment may also be used in combination.

In accordance with the present invention, it is possible to restrain the elastic deformation of a shadow mask when the shadow mask receives a compressive stress in a direction parallel to its surface. Specifically, by adjusting the balance in strength relative to compressive stresses between the panel side and the electron-gun side of a dome-shaped shadow mask, it is possible to prevent the shadow mask from being deformed into a concave shape.

Since the shadow mask having the above-described construction has the advantage that the perforated surface does not easily become sunken even after press forming, it is possible to facilitate formation of shadow mask structures, the operation of securing shadow mask structures to panels, and handling of shadow mask structures and cathode ray tubes.

In addition, since this shadow mask does not undergo a large deformation perpendicular to the shadow mask surface, the vibration of the shadow mask can be restrained. In other words, the cathode ray tube according to the present invention is capable of restraining howling.

By adopting the above-described construction, it is possible to enlarge the radius of curvature of the shadow mask to a further extent. In addition, since the deformation of the shadow mask can be restrained, it is possible to readily manufacture a color cathode ray tube panel having an outer surface close to a flat surface. Moreover, since the cathode ray tube according to the present invention has the advantage that the radius of curvature of the panel inner surface can be made large, the cathode ray tube is capable of displaying an image having no large distortion.

Moreover, in accordance with the construction according to the present invention, since the shadow mask can be manufactured with a small thickness, the amounts of materials can be reduced and the press forming of the shadow mask can readily be performed. In addition, by enlarging the lower holes, the aperture ratio of the electron beam passing holes is improved and the amount of illumination of electron beams is increased, whereby the screen brightness is improved. In addition, even if the pitch of holes is made small to cope with a higher definition, the brightness of the screen does not decrease.

Moreover, the amount of current for electron beams can be decreased to decrease energy consumption.

What is claimed is:

1. A shadow mask color cathode ray tube comprising:

a panel provided with a shadow mask in its inside;

a neck which contains an electron gun for emitting a plurality of electron beams; and a funnel which connects the panel and the neck, the shadow mask having a perforated portion which passes electron beams therethrough, the perforated portion having a plurality of electron beam passing holes each formed of an upper hole provided on a panel side and a lower hole provided on an electron-gun side which are connected to each other, each upper hole located in a central portion of the perforated portion having an aperture diameter smaller than a pitch of adjacent electron beam passing holes, a pitch of electron beam passing holes located in a peripheral portion of the perforated portion being equal to or larger than the pitch of the electron beam passing holes in the central portion, each upper hole located in the peripheral portion of the perforated portion being formed to have an elliptical shape having a longer axis extending in a radial direction of the shadow mask, a shorter axis of the elliptical shape being smaller than a diameter of the upper hole of each of the electron beam passing holes located in the central portion of the shadow mask.

2. A color cathode ray tube according to claim 1, wherein a horizontal pitch of the electron beam passing holes located in the peripheral portion is larger than a horizontal pitch of the electron beam passing holes located in the central portion.

3. A color cathode ray tube according to claim 1, wherein a longer diameter of the elliptical shape is larger than a diameter of each upper hole located in the central portion.

4. A color cathode ray tube according to claim 1, wherein the upper holes of the respective electron beam passing holes vary gradually from the central portion toward the peripheral portion.

5. A color cathode ray tube according to claim 1, wherein the shorter diameter of the elliptical shape has a length of about 90–65% of the diameter of each of the upper holes of the electron beam passing holes located in the central portion of the shadow mask.

6. A color cathode ray tube according to claim 3, wherein the shorter diameter of the elliptical shape has a length of about 90–65% of the diameter of each of the upper holes of the electron beam passing holes located in the central portion of the shadow mask.

7. A shadow mask color cathode ray tube comprising:

a panel;

a neck;

a funnel which connects the panel and the neck; and a shadow mask which is convex toward an inner surface of the panel and is disposed in the panel, the shadow mask being made of a perforated area having a plurality of electron beam passing holes and a imperforate area which surrounds the perforated area, an equivalent radius of curvature of the perforated portion of the shadow mask in a direction of a diagonal line CD being 1,400 mm or more, each of the electron beam passing holes being formed by connecting an upper hole provided on a panel side and a lower hole provided on an electron-gun side, each electron beam passing hole located in proximity to the imperforate area being formed in such a manner that its upper hole is formed in an elliptical shape having a longer diameter extending in a radial direction of the shadow mask and a shorter diameter of the elliptical shape is smaller than a diameter of the upper hole of each electron beam passing hole located in a central portion of the shadow mask.

8. A color cathode ray tube according to claim 7, wherein an aperture shape of the lower hole is circular.

9. A color cathode ray tube according to claim 7, wherein an aperture of the lower hole has an elliptical shape having a longer axis in a direction perpendicular to a longer axis of an aperture of the upper hole.

10. A color cathode ray tube according to claim 7, wherein the upper holes of the respective electron beam passing holes vary gradually from the central portion toward the peripheral portion.

11. A color cathode ray tube according to claim 7, wherein the shorter diameter of the elliptical shape has a length of about 90–65% of the diameter of each of the upper holes of the electron beam passing holes located in the central portion of the shadow mask.

* * * * *